US009295111B2

(12) United States Patent
Huang et al.

(10) Patent No.: US 9,295,111 B2
(45) Date of Patent: Mar. 22, 2016

(54) MICROWAVE OVEN

(75) Inventors: Zhifei Huang, Foshan (CN); Shiyong Liu, Foshan (CN); Xiaoyun Zheng, Foshan (CN); Minghua Hong, Foshan (CN)

(73) Assignee: MIDEA GROUP CO., LTD, Foshan (CN)

( * ) Notice: Subject to any disclaimer, the term of this patent is extended or adjusted under 35 U.S.C. 154(b) by 176 days.

(21) Appl. No.: 13/559,232

(22) Filed: Jul. 26, 2012

(65) Prior Publication Data

US 2014/0027447 A1 Jan. 30, 2014

(51) Int. Cl.
*H05B 6/64* (2006.01)
*H05B 6/74* (2006.01)

(52) U.S. Cl.
CPC ..... *H05B 6/6402* (2013.01)

(58) Field of Classification Search
CPC ..... H05B 6/64; H05B 6/705; H05B 6/6402; H05B 6/6426; H05B 6/6429
USPC ..... 219/725, 728, 745, 756, 678, 699, 750; D7/402
See application file for complete search history.

(56) References Cited

U.S. PATENT DOCUMENTS

| | | | | | |
|---|---|---|---|---|---|
| 3,461,260 | A * | 8/1969 | Bremer | 219/745 |
| 4,771,155 | A * | 9/1988 | Yangas | 219/745 |
| 5,698,128 | A * | 12/1997 | Sakai et al. | 219/745 |
| 6,121,594 | A * | 9/2000 | Joines et al. | 219/688 |
| D440,818 | S * | 4/2001 | Yamazumi | D7/402 |
| D447,001 | S * | 8/2001 | Yamazumi | D7/402 |
| 6,674,056 | B2 * | 1/2004 | Lee | 219/745 |
| 2011/0139773 | A1 * | 6/2011 | Fagrell et al. | 219/702 |

* cited by examiner

*Primary Examiner* — Dana Ross
*Assistant Examiner* — Lindsey C Teaters
(74) *Attorney, Agent, or Firm* — Hamre, Schumann, Mueller & Larson, P.C.

(57) ABSTRACT

The present invention relates to a microwave oven including an oven door and a heating chamber with a back wall, and the oven door is installed in the front of the heating chamber. There are more than one protrusion disposed on the back wall, and each of the protrusions has more than three reflecting surfaces and protrudes toward an inside of the heating chamber. The back wall of the heating chamber in the microwave oven has the structure of a plurality of reflecting surfaces, which makes the microwave emitted by a magnetron reach every position of the heating chamber by reflection of the multiple reflecting surfaces, thereby the microwave distributes more evenly and consistently, thus the food may be heated more rapidly and uniformly.

5 Claims, 3 Drawing Sheets

MICROWAVE OVEN

TECHNICAL FIELD

The present invention relates to a microwave oven.

BACKGROUND

At present, the heating chamber of every commercial microwave oven is composed of a top, a bottom, a back wall, two side walls and an oven door, all of which being of flat plate type. Because the launching position of the magnetron in the microwave oven is fixed, the reflection angle of microwave emitted by the magnetron formed by a reflection of the flat panel wall of the heating chamber is substantially fixed, therefore, the microwave distributes in every space point in a certain and regular way, i.e. the microwave at one space point is different from that of another, and the heating effect at a space point where more microwave is obtained is better than that of a space point where less microwave is obtained. Although the rotating tray has the effect of making the food thereon heated evenly, some parts of the food still cannot be heated sufficiently by getting more microwave because the distribution of the microwave in the heating chamber is uneven.

SUMMARY

The objective of the present invention is to provide a microwave oven with a reasonable design and can make sure that the microwave may distribute in every part of the heating chamber therein evenly.

To solve the above problem, the present invention provides a microwave oven including an oven door and a heating chamber. The oven door is installed in the front of the heating chamber. The heating chamber includes a back wall, and there are more than one protrusion disposed on the back wall, and each of the protrusions has more than three reflecting surfaces and protrudes toward an inside of the heating chamber.

In a microwave oven of an embodiment according to the present invention, each of the protrusions has the shape of a pyramid.

In a microwave oven of an embodiment according to the present invention, the protrusions are arranged uniformly on the back wall of the heating chamber.

In a microwave oven of an embodiment according to the present invention, two adjacent protrusions are connected to each other.

In a microwave oven of an embodiment according to the present invention, the reflecting surface has the shape of a triangle, and all of the reflecting surfaces on each protrusion meet at one point.

In a microwave oven of an embodiment according to the present invention, the protrusions and the back wall are punched into an integrated body.

In the present invention, the back wall of the heating chamber in the microwave oven has the structure of a plurality of reflecting surfaces to make the microwave emitted by a magnetron reach every position of the heating chamber by reflection of the multiple reflecting surfaces, thereby the microwave distributes more evenly and consistently, thus the food in the microwave oven may be heated more rapidly and uniformly.

DETAILED DESCRIPTION OF THE PREFERRED EMBODIMENTS

The present invention provides a microwave oven including an oven door and a heating chamber body. The oven door is disposed in the front of the heating chamber body, the heating chamber body has a back wall, and there are more than one protrusions with more than three reflecting surfaces disposed on the back wall, each of the protrusions protruding toward an inside of the heating chamber, so as to improve the uniformity of distribution of the microwave in the heating chamber. As a result, the microwave emitted by a magnetron in the microwave oven reaches every position of the heating chamber by reflection of the multiple reflecting surfaces after entering into the heating chamber, and the microwave distributes more evenly and consistently, thereby the food in the microwave oven may be heated more rapidly and uniformly.

The present invention will be more appreciated by detail description with reference to the accompanying drawings and the embodiments below.

Figure 1:
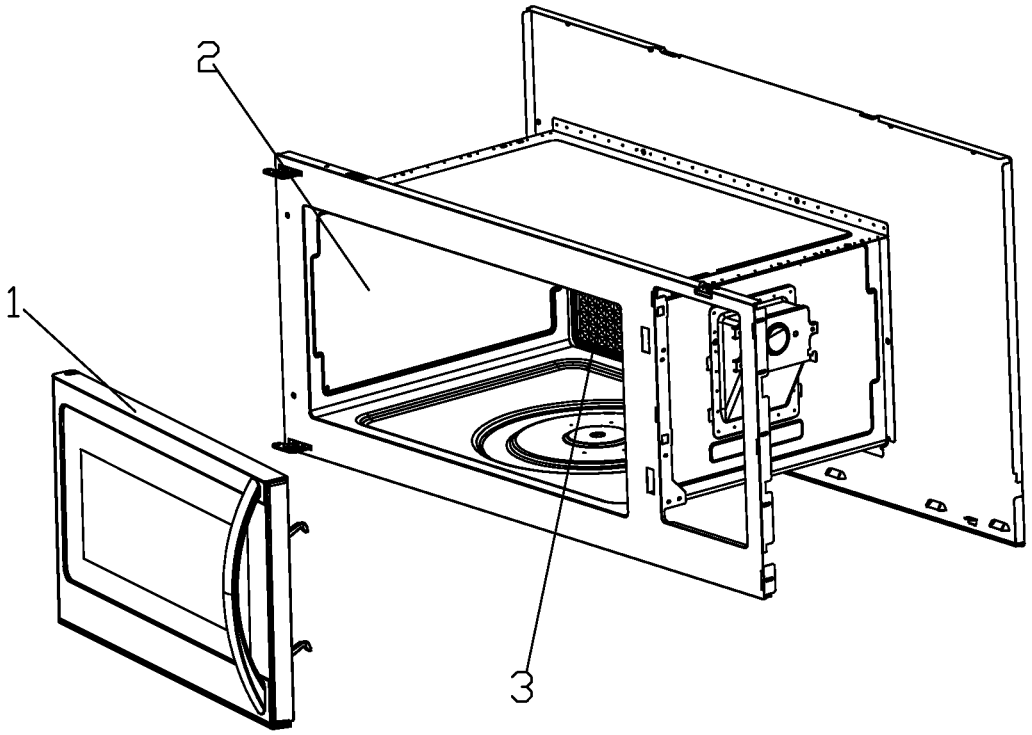
FIG. 1 is a schematic view of a microwave oven of a preferred embodiment according to the present invention.
Figure 2:
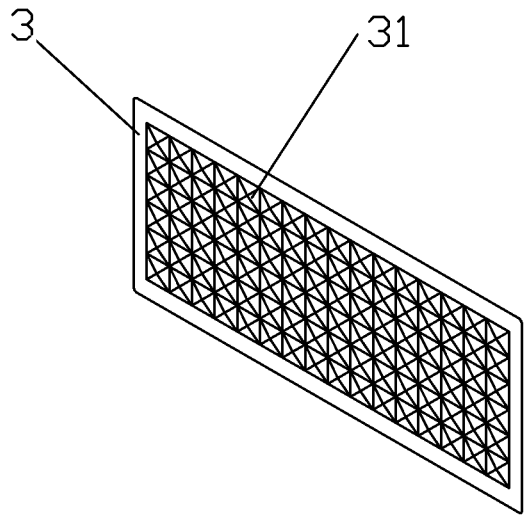
FIG. 2 is a schematic view of a back wall of the heating chamber in a preferred embodiment according to the present invention.
Figure 3:
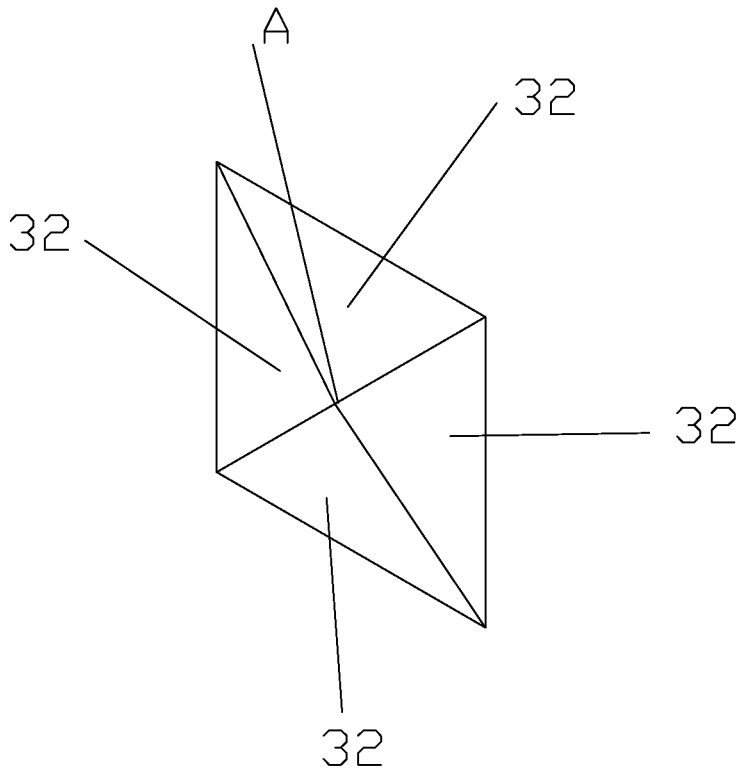
FIG. 3 is a schematic view of a protrusion on the back wall of the heating chamber of a microwave oven in a preferred embodiment according to the present invention.
Figure 4:
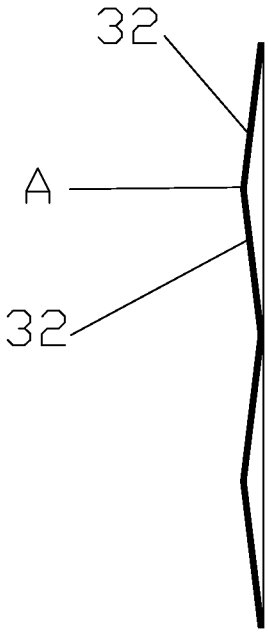
FIG. 4 is a sectional view of the protrusion on the back wall of the heating chamber in a preferred embodiment according to the present invention.

Referring to FIG. 1, in one preferred embodiment of the present invention, a microwave oven includes an oven door 1 and a heating chamber 2 having a back wall 3, wherein the oven door 1 is disposed in the front of the heating chamber 2. Referring to FIGS. 2 to 4, there are a plurality of protrusions 31 disposed on the back wall 3 of the heating chamber 2, wherein the protrusions 31 are uniformly aligned in a rectangular array on the back wall 3 of the heating chamber 2, each of the protrusions 31 is connected with a neighboring protrusion 31 thereof, i.e. the two adjacent protrusions 31 are disposed against each other without any space between them. In this embodiment, the protrusion 31 has the shape of a rectangular pyramid, which protrudes toward the inside of the heating chamber 2. Each of the protrusions 31 has four triangle shaped reflecting surfaces 32, all of which thereon meeting at one point A. For the convenience of processing, the back wall 3 and the multiple protrusions 31 thereon are punched into an integrated body.

The shape of each the protrusions 31 according the embodiments is not necessarily limited to the shape of a rectangular pyramid, but also may be the shape of a triangle pyramid, a pentagonal pyramid, a hexagonal pyramid, or another type of polygonal pyramid. Besides distributing in a uniform way, the protrusions 31 may have a random arrangement. Two adjacent protrusions 31 may be connected with each other, or have a certain space between them.

In the present invention, the protrusions disposed on the back wall of the microwave oven make the microwave emitted by a magnetron reach every position of the heating chamber by reflection of the multiple reflecting surfaces after entering into the heating chamber, thereby the microwave distributes more evenly and consistently, the food in the microwave oven may be heated more rapidly and uniformly.

The present invention may be embodied in other forms without departing from the spirit or novel characteristics thereof. The embodiments disclosed in this application are to be considered in all respects as illustrative and not limitative.

The scope of the invention is indicated by the appended claims rather than by the foregoing description; and all changes which come within the meaning and range of equivalency of the claims are intended to be embraced therein.

What is claimed is:

1. A microwave oven, comprising:

an oven door, a heating chamber, and a magnetron, the oven door being installed in the front of the heating chamber, the heating chamber including a back wall, a plurality of identical protrusions being disposed in a rectangular matrix on the back wall, wherein two of the plurality of identical protrusions disposed adjacent to each other tightly contact each other without any space between them, each of the protrusions having a shape of a regular pyramid with four triangle reflecting surfaces meeting at one point towards an inside of the heating chamber, and each of the reflecting surfaces being configured to reflect a microwave emitted by the magnetron.

2. The microwave oven of claim 1, wherein the protrusions are arranged uniformly on the back wall of the heating chamber.

3. The microwave oven of claim 1, wherein the protrusions and the back wall are punched into an integrated body.

4. The microwave oven of claim 1, wherein the protrusions are arranged throughout an entire surface of the back wall.

5. The microwave oven of claim 1, wherein the rectangular matrix is arranged throughout an entire surface of the back wall.

* * * * *